US006458752B1

(12) United States Patent
Rodrigues

(10) Patent No.: US 6,458,752 B1
(45) **Date of Patent: *Oct. 1, 2002**

(54) POWDER LAUNDRY DETERGENT HAVING ENHANCED SOILS SUSPENDING PROPERTIES

(75) Inventor: Klein A. Rodrigues, Signal Mountain, TN (US)

(73) Assignee: National Starch and Chemical Investment Holding Corporation, New Castle, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,838

(22) Filed: Mar. 23, 1999

(51) Int. Cl.[7] ..... C11D 3/37

(52) U.S. Cl. ..... 510/230; 510/229; 510/220; 510/475

(58) Field of Search ..... 510/350, 475, 510/321, 320, 220, 376, 530, 306, 305, 300, 229, 230

(56) References Cited

U.S. PATENT DOCUMENTS

| | | | | | |
|---|---|---|---|---|---|
| 3,904,685 | A | * | 9/1975 | Shahidi et al. | 260/537 |
| 4,444,561 | A | | 4/1984 | Denzinger et al. | 8/137 |
| 4,797,223 | A | * | 1/1989 | Amick et al. | 252/174.23 |
| 4,874,540 | A | * | 10/1989 | Greenwald et al. | 252/174.24 |
| 4,891,149 | A | * | 1/1990 | Nagarajan et al. | 252/110 |
| 5,008,032 | A | | 4/1991 | Diessel et al. | 252/174.24 |
| 5,126,069 | A | * | 6/1992 | Kud et al. | 252/174.23 |
| 5,130,369 | A | * | 7/1992 | Hughes et al. | 524/846 |
| 5,565,145 | A | | 10/1996 | Watson et al. | 510/350 |
| 5,719,117 | A | | 2/1998 | Falk et al. | 510/475 |
| 5,723,434 | A | | 3/1998 | Falk et al. | 510/475 |

* cited by examiner

*Primary Examiner*—Gregory E. Webb
(74) *Attorney, Agent, or Firm*—Thomas F. Roland, Esq.

(57) ABSTRACT

A powder detergent composition which exhibits improved soil suspending properties on organic non-polar and polar soils in wash liquors. The powder detergent comprises a water-soluble or water-dispersible polymer having pendant acid functionality and a terminal fragment of a chain transfer agent, wherein the polymer is the polymerization product of a ethylenically unsaturated acid monomer and a $C_1$ to $C_{24}$ chain transfer agent. The polymers also boost the cleaning performance of hard surface and dishware detergent compositions.

19 Claims, No Drawings

POWDER LAUNDRY DETERGENT HAVING ENHANCED SOILS SUSPENDING PROPERTIES

FIELD OF THE INVENTION

This invention relates to a powder detergent composition having enhanced soil suspending properties on organic non-polar and polar soils in wash liquors which comprises a water-soluble or water-dispersible polymer having pendant acid functionality and a terminal fragment of a chain transfer agent.

BACKGROUND OF THE INVENTION

Detergent formulators are faced with the task of devising products to remove a broad spectrum of soils and stains from fabrics. The varieties of soils and stains ranges from polar soils, such as proteinaceous, clay, and inorganic soils, to non-polar soils, such as soot, carbon-black, byproducts of incomplete hydrocarbon combustion, and organic soils. Detergent compositions have become more complex as formulators attempt to provide products which handle all types concurrently.

Formulators have been highly successful in developing traditional dispersants which are particularly useful in suspending polar, highly charged, hydrophilic particles such as clay. As yet, however, dispersants designed to disperse and suspend non-polar, hydrophobic-type soils and particulates have been more difficult to develop. Without wishing to be limited by theory, it is believed that the first step for dispersion formation is the adsorbance of the soil dispersing agent onto the soil of interest. For clay-like soils, the soil dispersing agent must adsorb onto a negatively charged surface. For organic particulates, the soil dispersing agent must adsorb onto a hydrophobic surface with little or no charge. Hence, for polar soils, like clay, a dispersing agent with some charge, such as charged polyacrylates, are employed. However, these charged dispersing agents have no driving force for adsorbing onto organic non-polar particulates.

U.S. Pat. No. 4,444,561 describes using copolymers prepared from 50 to 90 weight percent of a vinyl ester of $C_1$–$C_4$ aliphatic carboxylic acids, from to 35 weight percent of a N-vinyl lactam, and from 1 to 20 weight percent of a monomer containing basic nitrogen capable of forming a salt or quaternized product, in detergent compositions to inhibit soil redeposition. The disadvantage of using such copolymers, however, is that they are capable of forming cations which may complex with anionic surfactants under certain wash conditions and cause a decrease in cleaning performance. In addition, the cationic copolymers may also undesirably promote fabric graying over multiple washing cycles.

U.S. Pat. No. 5,008,032 describes using copolymers prepared from $C_4$–$C_{28}$ olefins and $\alpha,\beta$-ethylenically unsaturated dicarboxylic anhydrides in detergent formulations. The disadvantage of using such copolymers, however, is that the copolymers are not water-soluble unless hydrolyzed with NaOH.

U.S. Pat. No. 5,723,434 describes a soil removal and soil resistant detergent composition containing a vinyl amide polymer which is prepared from 5 to 100 weight percent of a vinyl amide monomer and from 0 to 95 weight percent of a vinyl ester monomer. While the detergent compositions are effective for removing soil from hydrophobic articles such as polyester, such compositions are not as effective for cleaning hydrophilic substrates such as cotton.

U.S. Pat. No. 5,565,145 describes detergent compositions containing ethoxylated/propoxylated polyalkyleneamine polymers, such as poly(ethyleneimine), which provide soil dispersing properties. While the detergent compositions are effective for removing nonpolar soils, such detergent compositions are not as effective for removing polar soils.

U.S. patent application Ser. No. 09/262,566, filed Mar. 4, 1999, describes isotropic liquid detergent compositions containing polymers having pendant acid functionality and a terminal fragment of a chain transfer agent. Such polymers are used to stabilize the isotropic liquid detergent composition and produce clear solutions by preventing phase separation. However, no mention is made of the possibility of using such polymers in powdered laundry detergents.

While liquid detergents are gaining popularity over powder detergents in the United States, powders remain more popular than liquid detergents outside the United States. Moreover, there is a trend to reduce the amount of water in the wash liquor for environmental reasons, thereby increasing the amount of dirt and soil that needs to be suspended in the wash liquor. For these reasons, there continues to be a need for a powder detergent composition which can be used to provide effective soil dispersing on organic non-polar and polar soils in wash liquors.

SUMMARY OF THE INVENTION

It has now been discovered that powder detergent compositions comprising polymers having pendant acid functionality and a terminal fragment of a chain transfer agent are effective for removing and dispersing organic non-polar and polar soils from fabrics in wash liquors. Furthermore, said polymers boost the cleaning performance of hard surface and dishware detergent compositions.

The present invention provides a powder detergent composition comprising at least one surfactant and builder and from about 0.1 to about 75 weight percent, based on the total weight of the powder detergent composition, of a water-soluble or water-dispersible polymer having pendant acid functionality and a terminal fragment of a chain transfer agent, wherein the polymer is the polymerization product of 50 to 99.999 weight percent of a ethylenically unsaturated acid monomer and 0.001 to 50 weight percent of a $C_1$ to $C_{24}$ chain transfer agent, wherein the weight percents are based on the weight of the total monomer and chain transfer agent.

According to another aspect the invention provides a powder detergent composition comprising at least one surfactant and builder and from about 0.1 to about 75 weight percent, based on the total weight of the powder detergent composition, of a water-soluble or water-dispersible polymer having pendant acid functionality and a terminal fragment of a chain transfer agent, wherein the polymer is the polymerization product of 50 to 99.999 weight percent of a ethylenically unsaturated acid monomer, 0.1 to 50 weight percent of a ethylenically unsaturated comonomer, and 0.001 to 50 weight percent of a $C_1$ to $C_{24}$ chain transfer agent, wherein the weight percents are based on the weight of the total monomer and chain transfer agent.

According to an additional aspect the invention provides a method for cleaning textiles comprising preparing the powder detergent composition as described above; contacting the powder detergent composition with one or more textiles wherein at least one of the textiles contains soil; and removing at least a portion of the soil from the textile containing soil.

DESCRIPTION OF THE INVENTION

This invention provides a powder detergent composition which contains at least one surfactant and builder and from about 0.1 to about 75 weight percent, based on the total weight of the powder detergent composition, of a water-soluble or water-dispersible polymer having pendant acid functionality and a terminal fragment of a chain transfer agent. Preferably, the powder detergent composition contains from about 0.5 to about 25 weight percent, more preferably from about 1 to about 10 weight percent of the polymer.

The polymer having pendant acid functionality and a terminal fragment of a chain transfer agent comprises a hydrophilic "backbone" component which is prepared from at least one monomer as discussed above and a "terminal" portion which is a fragment of a chain transfer agent. The hydrophilic backbone generally is a linear or branched molecular composition preferably containing one type of relatively hydrophilic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight. The terminal portion of the polymer is a linear or branched hydrophobe.

The polymer having pendant acid functionality and a terminal fragment of a chain transfer agent is the polymerization product of 50 to 99.999 weight percent of a ethylenically unsaturated acid monomer and 0.001 to 50 weight percent of a $C_1$ to $C_{24}$ chain transfer agent, wherein the weight percents are based on the weight of the total monomer and chain transfer agent. Preferably, the polymer is the polymerization product of 60 to 95 weight percent of a ethylenically unsaturated acid monomer and 5 to 40 weight percent of a $C_1$ to $C_{24}$ chain transfer agent. More preferably, the polymer is the polymerization product of 80 to 90 weight percent of a ethylenically unsaturated acid monomer and 10 to 20 weight percent of a $C_1$ to $C_{24}$ chain transfer agent.

The chain transfer agent has from 1 to 24 carbon atoms, preferably 1 to 14 carbon atoms, more preferably 3 to 12 carbon atoms, and is selected from mercaptans or thiols, amines and alcohols. A combination of chain transfer agents can also be used. The chain transfer agent does not contain a reactive vinyl group and is not copolymerized with the other monomer(s) used to prepare the polymer. The chain transfer agent functions to terminate propagating polymeric chains, and in some instances, supplies a free radical capable of initiating new polymer molecules.

Suitable mercaptans which are useful as chain transfer agents are organic mercaptans which contain at least one—SH or thiol group and which are classified as aliphatic, cycloaliphatic, or aromatic mercaptans. The mercaptans can contain other substituents in addition to hydrocarbon groups, such substituents including carboxylic acid groups, hydroxyl groups, ether groups, ester groups, sulfide groups, amine groups and amide groups. Suitable mercaptans are, for example, methyl mercaptan, ethyl mercaptan, butyl mercaptan, mercaptoethanol, mercaptopropanol, mercaptobutanol, mercaptoacetic acid, mercaptopropionic acid, thiomalic acid, benzyl mercaptan, phenyl mercaptan, cyclohexyl mercaptan, 1-thioglycerol, 2.2'-dimercaptodiethyl ether, 2,2'-dimercaptodipropyl ether, 2,2'-dimercaptodisopropyl ether, 3,3'-dimercaptodipropyl ether, 2,2'-dimercaptodiethyl sulfide, 3,3'-dimercaptodipropyl sulfide, bis(beta-mercaptoethoxy)methane, bis(beta-mercaptoethylthio)methane ethanedithio-1,2, propanedithiol-1,2, butanedithiol-1,4, 3,4-dimercaptobutanol-1, trimethylolethane tri(3-mercaptopropionate), pentaerythritol tetra(3-mercaptopropionate), trimethylolpropane trithioglycolate, pentaerythritol tetrathio-glycolate, octanethiol, decanethiol, dodecanethiol, and octadecylthiol. Preferred mercaptan chain transfer agents include 3-mercaptopropionic acid and dodecanediol.

Suitable amines which are useful as chain transfer agents are, for example, methylamine, ethylamine, isopropylamine, n-butylamine, n-propylamine, iso-butylamine, t-butylamine, pentylamine, hexylamine, benzylamine, octylamine, decylamine, dodecylamine, and octadecylamine. A preferred amine chain transfer agent is isopropyl amine and docylamine.

Suitable alcohols which are useful as chain transfer agents are, for example, methanol, ethanol, isopropanol, n-butanol, n-propanol, iso-butanol, t-butanol, pentanol, hexanol, benzyl alcohol, octanol, decanol, dodecanol, and octadecanol. A preferred alcohol chain transfer agent is isopropanol and dodecanol.

The ethylenically unsaturated acid monomer is selected from unsaturated dicarboxylic acids, unsaturated carboxylic acids, sulfonic acids, and phosphonic acids. Combinations of ethylenically unsaturated acid monomers can also be used. Suitable ethylenically unsaturated acid monomers are, for example, acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, maleic anhydride, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, sodium methallyl sulfonate, sulfonated styrene, and allyloxybenzenesulfonic acid. Preferably, the ethylenically unsaturated acid monomer is selected from acrylic acid, maleic acid, and itaconic acid.

Alternatively, 0.1 to 50 weight percent of the ethylenically unsaturated acid monomer may be replaced with a ethylenically unsaturated comonomer. If present, the ethylenically unsaturated comonomer is preferably present in an amount of 10 to 40 weight percent, more preferably 20 to 30 weight percent, based on the total weight of monomer and chain transfer agent. The ethylenically unsaturated comonomer is distinguished from the ethylenically unsaturated acid monomer in that the ethylenically unsaturated comonomer does not contain an acid functional group. However, the ethylenically unsaturated comonomer may contain other functional groups such as hydroxy and/or amide groups. The ethylenically unsaturated comonomer is selected from vinyl esters, alkyl esters of acrylic and methacrylic acid, substituted or unsubstituted mono and dialkyl esters of unsaturated dicarboxylic acids or carboxylic acids, vinyl aromatics, unsubstituted or substituted acrylamides, cyclic monomers, monomers containing alkoxylated side chains, -olefins, and vinyl amide monomers. A combination of ethylenically unsaturated comonomers may also be used.

Suitable vinyl esters are, for example, vinyl acetate, vinyl formate, vinyl propionate, vinyl butyrate, vinyl isobutyrate, vinyl valerate, vinyl 2-ethyl-hexanoate, etc. Suitable alkyl esters of acrylic and methacrylic acid are, for example, methyl acrylate, ethyl acrylate, n-propyl acrylate, isopropyl acrylate, n-butyl acrylate, isobutyl acrylate, t-butyl acrylate, isobornyl acrylate, pentyl acrylate, hexyl acrylate, octyl acrylate, iso-octyl acrylate, nonyl acrylate, lauryl acrylate, stearyl acrylate, eicosyl acrylate, 2-ethylhexyl acrylate, cyclohexyl acrylate, cycloheptyl acrylate, methyl methacrylate, ethyl methacrylate, propyl methacrylate, n-butyl methacrylate, t-butyl methacrylate, isobutyl methacrylate, pentyl methacrylate, hexyl methacrylate, cyclohexyl methacrylate, 2-ethylhexyl methacrylate, isobornyl methacrylate, heptyl methacrylate, cycloheptyl methacrylate, octyl methacrylate, iso-octyl methacrylate, nonyl methacrylate, decyl methacrylate, lauryl methacrylate, eicosyl methacrylate, etc.

Suitable substituted or unsubstituted mono and dialkyl esters of unsaturated dicarboxylic acids or carboxylic acids are, for example, substituted and unsubstituted mono and dibutyl, mono and diethyl maleate esters as well as the corresponding fumarates. Suitable vinyl aromatic monomers are, for example, 3-isopropenyl-, -dimethylbenzyl isocyanate, and halogenated styrenes. Suitable acrylamide based monomers are, for example, acrylamide, N,N dimethyl-acrylamide, N-octyl acrylamide, N-methylol acrylamide, dimethylaminoethyl-acrylate, etc. Suitable cyclic monomers are, for example, vinyl pyrrolidone, vinyl imidazolidone, vinyl pyridine, etc. Suitable vinyl amide monomers are, for example, N-vinyl formamide, N-vinyl acetamide, etc. Suitable $\alpha$-olefin based monomers are, for example, $C_4$ to $C_{20}$ based alkyl monomers such as 1-octene, butylene, 1 dodecene, etc. The ethylenically unsaturated comonomer is preferably acrylamide or vinyl acetate.

The water-soluble or water-dispersible polymer having pendant acid functionality and a terminal fragment of a chain transfer agent can be prepared by any of the known polymerization processes such as solution, emulsion, suspension, or bulk polymerization. Such polymerization processes are well known in the art. In a preferred embodiment, the polymers are prepared by solution polymerization in water. In another preferred embodiment, especially where the ethylenically unsaturated comonomer is not completely water-soluble, the polymers may be prepared by solution polymerization in a water and alcohol mixture. The alcohol cosolvent may be removed at the end of the polymerization reaction by distillation prior to or following neutralization.

The water-soluble or water-dispersible polymer having pendant acid functionality and a terminal fragment of a chain transfer agent may be neutralized or partially neutralized with an alkali or alkali metal to form an alkaline salt. Examples of alkali or alkali metals are sodium, potassium, cesium, ethanolamine, diethanolamine, triethanolamine, etc. Preferably, the polymer is 50% to 100% neutralized, more preferably, 80% to 90% neutralized.

In one embodiment, the powder detergent composition is used in a household laundry detergent. Typically such laundry detergents are manufactured by a spray drying process in which surfactants and builders are incorporated into an aqueous crutcher slurry fed into a spray tower. Such. processes are ideal for obtaining fluffy, light-density powders (approximately 0.3g/cm$^3$).

In another embodiment, the powder detergent composition is manufactured in more compact powder detergents which involves removal of inert fillers, control of spray drying to minimize porosity of powder granules, minimization of occluded volumes within both powder granules and the packed powder bed, and reformulation on the basis of the most volume-efficient materials. Compact powders also offers increased opportunities to utilize a wider range of processing techniques. Low-active aqueous solutions can be conveniently used in spray tower processes. In contrast, high-active surfactant forms are required for agglomeration and dry blending.

In another embodiment, the powder detergent compositions are prepared by dry blending which refers to the direct blending of dry powder ingredients. Although the process is quite simple in nature and can produce high-density products, the restrictions for dry forms of surfactant such as powders or flakes severely limits the usefulness of this technique for manufacture of compact detergent powders. In addition, component segregation can occur due to the varying densities of the ingredients. Bulk densities 0.6 g/cm$^3$ are also easily achieved by agglomeration processes. Agglomeration processes, although more complex than drying blending, require less capital investment and are also much less energy intensive than spray-drying. In this case, liquid silicates and/or liquid surfactants such as alcohol ethoxylates act as the agglomeration agent to hold the builder particles together and increase particle size. Various types of agglomeration equipment are available to allow efficient mixing of the liquid and powder ingredients.

In another embodiment, combination processes are used to prepare the powder detergent composition in the form of a compact powder. For example, liquid nonionic surfactants can be sprayed onto spray-dried powders containing only builder or builder and anionic surfactant. By filling the voids within the spray-dried bead, the liquid surfactant, such as alcohol ethoxylate, increases the density of the final product. Similarly, increased density and improved powder flow properties have been reported for a detergent produced by first coating a spray-dried base powder with zeolite followed by spraying with a nonionic surfactant. Higher densities approaching 1.0 g/cm$^3$ are achieved when the spray-dried powder is compressed and then extruded in the presence of non-ionic surfactant. New processes in which fluid bed drying is incorporated long with the spray dryer and agglomerator have also been developed which provide greater flexibility in density and composition.

Examples of surfactants useful in the powder detergent compositions herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^{30})CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_2$–$C_{18}$ N-methylglucamides. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{18}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Builders used in the powder detergent compositions include organic and inorganic builders. The level of builder can vary widely depending upon the end use of the composition and its desired physical form. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. The detergent compositions function well in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates. NaSKS-6 is the trademark for a crystalline layered silicate marketed by Hoechst. Unlike zeolite builders, the NaSKS-6 silicate builder does not contain aluminum. NaSKS-6 has the delta-$Na_2SiO_5$ morphology form of layered silicate. Other layered silicates, such as those having the general formula $NaMSi_xO_{2x+1y}H_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. Other silicates may also be useful such as for example magnesium silicate, which can serve as a crispening agent in granular formulations, as a stabilizing agent for oxygen bleaches, and as a component of suds control systems.

Aluminosilicate builders are useful in the present invention. Aluminosilicate builders are important in most currently marketed heavy duty granular detergent compositions. Aluminosilicate builders include those having the formula: $M_z[(ZAlO_2)_y].xH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula: $Na_{12}[(AlO_2)_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Additional builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt) can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and related compounds. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates.

The powder detergent compositions may include one or more enzymes. Such enzymes include, for example, lipases, proteases, amylases, peroxidases and the like which are well known in the art. The enzymes may be used together with cofactors required to promote enzyme activity. It should also be understood that enzymes having mutations at various positions (e.g., enzymes engineered for performance and/or stability enhancement) are also contemplated by the invention. Enzymes are normally incorporated at levels sufficient to provide up to about 5 mg by weight, more typically about 0.01 mg to about 3 mg, of active enzyme per gram of the composition.

The detergent compositions may optionally contain bleaching agents or bleaching compositions containing a bleaching agent and one or more bleach activators when formulated appropriately by those skilled in the art. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Highly preferred bleaching agents also include 6-nonylamino-6-oxoperoxycaproic acid.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. The nonanoyloxybenzene sulfonate (NOBS) and tetraacetyl ethylene diamine (TAED) activators are typical, and mixtures thereof can also be used. Bleaching agents other than oxygen bleaching agents are also known in the art and can be utilized herein.

The powder detergent compositions may further comprise at least one additive. Suitable additives may include, for example, dye transfer inhibitors, anticorrosion materials, antistatic agents, optical brighteners, perfumes, fragrances, dyes, fillers, chelating agents, fabric whiteners, brighteners, sudsing control agents, buffering agents, soil release agents, fabric softening agents, and combinations thereof. In general, such additives and their amounts are known to those skilled in the art.

The following nonlimiting examples illustrate further aspects of the invention.

EXAMPLE 1

311.5 grams of water was added to a 2 liter reaction vessel and heated to 96° C. 398.6 grams of acrylic acid were slowly added to the reactor using a pump over a three hour period. Also, 33.9 grams of 3-mercaptopropionic acid was dissolved in 44 grams of water and fed into the reactor over a three hour period of time concurrent with the acrylic acid feed. 6.2 grams of sodium persulfate was dissolved in 41 grams of water and added to the reactor over a period of three hours and 15 minutes concurrent with the acrylic acid feed, except for the additional 15 minutes to react any residual monomer. The reaction mixture was held at 96° C. for 30 minutes and subsequently cooled to 90° C.

A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 0.4 grams of a 5.0 weight percent solution of sodium hydroxide was added to reactor with cooling. The final polymer solution was a viscous liquid having a solids content of approximately 50 weight percent and having a pH of 2.7.

A solution of the polymer weighing 38.3 grams was neutralized with 16.1 grams of 50 weight percent sodium hydroxide to a pH of 7.5. The neutralized polymer solution was a clear viscous liquid having a solids content of approximately 43 weight percent.

EXAMPLE 2

A sample of itaconic acid weighing 72 grams was stirred into 311.5 grams of water in a 2 liter reaction vessel and heated to 96° C. The solid itaconic acid was completely dissolved during the heating process. 358.7 grams of acrylic acid were slowly added to the reactor using a pump over a three hour period. Concurrent with the acrylic acid feed, 33.9 grams of 3-mercaptopropionic acid was dissolved in 44 grams of water and fed into the reactor over three hours, and 6.2 grams of sodium persulfate was dissolved in 41 grams of water and added to the reactor over a period of three hours and 15 minutes, except for the additional 15 minutes to react any residual monomer. The reaction mixture was held at 96° C. for 30 minutes and subsequently cooled to 90° C. A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 443 grams of a 50 weight percent solution of sodium hydroxide was added to reactor with cooling. The final polymer solution was a clear viscous liquid.

EXAMPLE 3

A sample of itaconic acid weighing 144 grams was stirred into 311.5 grams of water in a two liter reaction vessel and heated to 96° C. The solid itaconic acid was completely dissolved during the heating process. 319 grams of acrylic acid were slowly added to the reactor using a pump over a three hour period. Also, 33.9 grams of 3-mercaptopropionic acid was dissolved in 41 grams of water and fed in to the reactor over three hours concurrent to the acrylic acid feed. 6.2 grams of sodium persulfate was dissolved in 75 grams of water and added to the reactor over a period of three hours and 15 minutes concurrent with the acrylic acid feed, except for the additional 15 minutes to react any residual monomer. The reaction mixture was held at 96° C. for 30 minutes and subsequently cooled to 90° C. A 0.7 gram solution of tert-butyl hydroperoxide (70 weight percent) followed by a 1.8 grams solution of sodium bisulfite (41 weight percent) were slowly added to the reactor. The reaction mixture was held at 96° C. for 30 minutes and then cooled to 85° C. A solution of 35 weight percent hydrogen peroxide weighing 7.2 grams was then added to the reactor. The reaction mixture was cooled and 30.6 grams of water and 443 grams of a 50 weight percent solution of sodium hydroxide was added to reactor with cooling. The final polymer solution was a clear viscous liquid with a solids content of approximately 44 weight percent and a pH of 6.7.

EXAMPLE 4

Synthesis of Hydrophobically Modified Polyacrylic Acid with a $C_{12}$ Chain Transfer Agent 524.8 g of water and 174 g of isopropyl alcohol were heated in a reactor to 85° C. A mixture of 374 g of acrylic acid and 49 g of n-dodecylmercaptan were added to the reactor over a period of three hours. After addition was completed, 65.3 g of acrylic acid was added over a period of 30 minutes to the reactor. At the same time, a solution of 17.5 g of sodium persulfate in 175 g of water was added to the reactor over a period of four hours. The temperature of the reactor was maintained at 85–95° C. for one hour, after which time, 125 g of water, 51 g of a 50% NaOH solution, and 0.07 g of ANTIFOAM 1400, available from Dow Chemical Company, were added to the reactor. The reaction mixture was distilled to remove the isopropyl alcohol. Approximately 300 g of a mixture of isopropyl alcohol and water were distilled off. The reaction mixture was cooled to room temperature and 388 g of a 50% NaOH solution was added.

EXAMPLE 5

Evaluation of Anti-redeposition Properties

The hydrophobically modified polyacrylic acid with a $C_{12}$ chain transfer agent prepared in Example 4 was evaluated in a detergent composition for antiredeposition properties and compared to a detergent composition without the polymer. The anti-redeposition test was conducted in a terg-o-tometer using three 4×4.5" cotton swatches and three 4×4.5" EMPA 213 (polycotton swatches available from Test Fabrics). Five 4×4" polycotton swatches were used as ballast. The wash cycle was 10 minutes using 0.9 g/L of powder detergent (composition listed below) and 150 ppm hardness water with a Ca to Mg ratio of 2:1. The soil used 0.46 g/L bandy black clay and 0.9 g/L of an oil blend (70% vegetable oil and 30% mineral oil). The polymer and copolymers were dosed at 1 weight percent of the detergent weight. The rinse cycle was 3 minutes using 150 ppm hardness water with a Ca to Mg ratio of 2:1. A total of three wash, rinse and dry cycles were carried out. The swatches were dried in a tumble dryer on medium setting. The L a b values before the first cycle and after the third cycle was measured as $L_1$, $a_1$, $b_1$ and $L_2$, $a_2$, $b_2$ respectively.

$$\Delta E=[(L_1-L_2)^2+(a_1-a_2)^2+(b_1-b_2)^2]^{0.5}$$

The powder detergent was prepared as follows: 100 g of Zeolite A (Valfor 100 from Crossfield), 40 g of sodium carbonate, 100 g of a 40% sodium silicate solution, 16 g of NEODAL 25-7 from Shell Chemical, 90 g of dodecylbenzene sodium sulfonate (COLONIAL 1240 from Colonial Chemical) and 176.8 grams of sodium sulfate was mixed together using a mortar and pestle till a free flowing homogenous powder was obtained. The test results are summarized in Table I.

TABLE I

| Soil Suspension Test | | | | |
|---|---|---|---|---|
| Polymer | ΔE for cotton | Ave ΔE for cotton | Ave ΔE for polycotton | Ave ΔE for polycotton |
| Blank | 3.22 | 3.15 | 1.52 | 1.52 |
| | 3.24 | | 1.53 | |
| | 3.0 | | 1.51 | |

TABLE I-continued

| Soil Suspension Test | | | | |
|---|---|---|---|---|
| Polymer | ΔE for cotton | Ave ΔE for cotton | Ave ΔE for polycotton | Ave ΔE for polycotton |
| Polymer of Example 4 | 1.79 | 1.72 | 0.79 | 0.84 |
| | 1.70 | | 0.85 | |
| | 1.69 | | 0.88 | |

The test results in Table I clearly show that powder detergent compositions containing the hydrophobically modified polyacrylic acid with a $C_{12}$ chain transfer agent which was prepared in Example 4 suspend significantly more clays (polar non-organic soils) and oils (non-polar organic soils) as compared to powder detergent compositions without the polymers of the invention.

While the invention has been described with particular reference to certain embodiments thereof, it will be understood that changes and modifications may be made by those of ordinary skill within the scope and spirit of the following claims.

What is claimed is:

1. A powder detergent composition comprising at least one surfactant and builder and from about 0.1 to about 75 weight percent, based on the total weight Of the powder detergent composition, of a water-soluble or water-dispersible polymer having pendant acid functionality and a terminal fragment of a chain transfer agent, wherein the polymer is the polymerization product of 60 to 95 weight percent of a ethylenically unsaturated acid monomer and 5 to 40 weight percent of a $C_3$ to $C_{24}$ chain transfer agent, wherein the weight percents are based on the weight of the total monomer and chain transfer agent.

2. The powder detergent composition according to claim 1 wherein the polymer is the polymerization product of 80 to 90 weight percent of a ethylenically unsaturated acid monomer and 10 to 20 weight percent of a $C_3$ to $C_{24}$ chain transfer agent.

3. The powder detergent composition according to claim 1 wherein the polymer is present in an amount of from about 0.5 to about 25 weight percent.

4. The powder detergent composition according to claim 1 wherein the ethylenically unsaturated acid monomer is selected from the group consisting of unsaturated dicarboxylic acids, unsaturated carboxylic acids, sulfonic acids, phosphonic acids, and combinations thereof.

5. The powder detergent composition according to claim 4 wherein the ethylenically unsaturated acid monomer is selected from the group consisting of acrylic acid, methacrylic acid, ethacrylic acid, alpha-chloro-acrylic acid, alpha-cyano acrylic acid, beta methyl-acrylic acid (crotonic acid), alpha-phenyl acrylic acid, beta-acryloxy propionic acid, sorbic acid, alpha-chloro sorbic acid, angelic acid, cinnamic acid, p-chloro cinnamic acid, beta-styryl acrylic acid (1-carboxy-4-phenyl butadiene-1,3), itaconic acid, maleic acid, maleic anhydride, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, vinyl phosphonic acid, sodium methallyl sulfonate, sulfonated styrene, allyloxybenzenesulfonic acid, and combinations thereof.

6. The powder detergent composition according to claim 5 wherein the ethylenically unsaturated acid monomer is selected from the group consisting of acrylic acid, itaconic acid, and maleic acid.

7. A powder detergent composition comprising at least one surfactant and builder and from about 0.1 to about 75 weight percent, based on the total weight of the powder detergent composition, of a water-soluble or water-dispersible polymer having pendant acid functionality and a terminal fragment of a chain transfer agent, wherein the polymer is the polymerization product of 60 to 95 weight percent of a ethylenically unsaturated acid monomer, 0.1 to 50 weight percent of a ethylenically unsaturated comonomer, and 5 to 40 weight percent of a $C_3$ to $C_{24}$ chain transfer agent, wherein the weight percents are based on the weight of the total monomer and chain transfer agent.

8. The powder detergent composition according to claim 7 wherein the ethylenically unsaturated comonomer is selected from the group consisting of vinyl esters, alkyl esters of acrylic and methacrylic acid, substituted or unsubstituted mono and dialkyl esters of unsaturated dicarboxylic acids or carboxylic acids, vinyl aromatics, unsubstituted or substituted acrylamides, cyclic monomers, monomers containing alkoxlated side chains, -olefins, vinyl amide monomers, and combinations thereof.

9. The powder detergent composition according to claim 8 wherein the ethylenically unsaturated comonomer is selected from the group consisting of acrylamide and vinyl acetate.

10. The powder detergent composition according to claim 1 wherein the chain transfer agent is selected from the group consisting of mercaptans, amines, alcohols, and combinations thereof.

11. The powder detergent composition according to claim 10 wherein the mercaptan is selected from the group consisting of butyl mercaptan, mercaptopropanol, mercaptobutanol, mercaptopropionic acid, benzyl mercaptan, phenyl mercaptan cyclohexyl mercaptan, 1-thioglycerol, 2,2'-dimercaptodiethyl ether, 2,2'-dimercaptodipropyl ether, 2,2'dimercaptodiisopropyl ether, 3,3'-dimercaptodipropyl ether, 2,2'-dimercaptodiethyl sulfide, 3,3'-dimercaptodipropyl sulfide, bis(beta-mercaptoethoxy) methane, bis(beta-mercaptoethylthio)methane ethanedithio-1,2, propanedithiol-1,2, butanedithiol-1,4, 3,4-dimercaptobutanol-1, trimethylole-thane tri(3-mercaptopropionate), pentaerythritol tetra(3-mercaptopropionate), trimethylolpropane trithioglycolate, pentaerythritol tetrathioglycolate, octanethiol, decanethiol, dodecanethiol, and octadecylthiol.

12. The powder detergent composition according to claim 11 wherein the chain transfer agent is 3-mercaptopropionic acid or dodecanethiol.

13. The powder detergent composition according to claim 10 wherein the amine is selected from the group consisting of methylamine, ethylamine, isopropylamine, n-butylamine, n-propylamine, iso-butylamine, t-butylamine, pentylamine, hexylamine, benzylamine, octylamine, decylamine, dodecylamine, and octadecylamine.

14. The powder detergent composition according to claim 13 wherein the chain transfer agent is isopropyl amine or dodecylamine.

15. The powder detergent composition according to claim 10 wherein the alcohol is selected from the group consisting of methanol, ethanol, isopropanol, n-butanol, n-propanol, iso-butanol, t-butanol, pentanol, hexanol, and benzyl alcohol, octanol, decanol, dodecanol, and octadecanol.

16. The powder detergent composition according to claim 15 wherein the chain transfer agent is isopropanol or dodecanol.

17. The powder detergent composition according to claim 1 wherein the chain transfer agent has 3 to 14 carbon atoms.

18. The powder detergent composition according to claim 1 further comprising at least one additive selected from the group consisting of ion exchangers, alkalies, anticorrosion materials, antiredeposition materials, antistatic agents, optical brighteners, perfumes, fragrances, dyes, fillers, oils, chelating agents, enzymes, fabric whiteners, brighteners, sudsing control agents, solvents, hydrotropes, bleaching agents, bleach precursors, buffering agents, soil removal agents, soil release agents, fabric softening agent, and opacifiers.

19. A method for cleaning textiles comprising (i) preparing a powder detergent composition comprising at least one surfactant and builder and from about 0.1 to about 75 weight percent, based on the total weight of the powder detergent composition, of a water-soluble or water-dispersible polymer having pendant acid functionality and a terminal fragment of a chain transfer agent wherein the polymer is the polymerization product of 60 to 95 weight percent of a ethylenically unsaturated acid monomer and 5 to 40 weight percent of a $C_3$ to $C_{24}$ chain transfer agent, wherein the weight percents are based on the weight of the total monomer and chain transfer agent;

(ii) contacting the powder detergent composition with one or more textiles wherein at least one of the textiles contains soil; and (iii) removing at least a portion of the soil from the textile containing soil.

* * * * *